US009620140B1

(12) United States Patent
Linnig

(10) Patent No.: US 9,620,140 B1
(45) Date of Patent: Apr. 11, 2017

(54) VOICE PITCH MODIFICATION TO INCREASE COMMAND AND CONTROL OPERATOR SITUATIONAL AWARENESS

(71) Applicant: RAYTHEON COMPANY, Waltham, MA (US)

(72) Inventor: Michael J. Linnig, Allen, TX (US)

(73) Assignee: RAYTHEON COMPANY, Waltham, MA (US)

( * ) Notice: Subject to any disclaimer, the term of this patent is extended or adjusted under 35 U.S.C. 154(b) by 0 days.

(21) Appl. No.: 14/993,916

(22) Filed: Jan. 12, 2016

(51) Int. Cl.

| | |
|---|---|
| ***G10L 25/00*** | (2013.01) |
| ***G10L 21/013*** | (2013.01) |
| ***G10L 25/90*** | (2013.01) |
| ***G10L 25/24*** | (2013.01) |
| ***G10L 21/0364*** | (2013.01) |

(52) U.S. Cl.
CPC ..... *G10L 21/013* (2013.01); *G10L 21/0364* (2013.01); *G10L 25/24* (2013.01); *G10L 25/90* (2013.01)

(58) Field of Classification Search
CPC .. A63F 13/12; A63F 13/87; A63F 2300/1081; A63F 2300/572; G10L 15/22
USPC ..... 704/275, 278; 725/10, 12
See application file for complete search history.

(56) References Cited

U.S. PATENT DOCUMENTS 8,234,110 B2 7/2012 Meng et al.
8,904,416 B2 * 12/2014 Harada ..... H04N 21/42201 725/10
9,244,600 B2 * 1/2016 McIntosh ..... G11B 27/105
2014/0214429 A1 * 7/2014 Pantel ..... G10L 21/16 704/275
2015/0170645 A1 * 6/2015 Di Censo ..... G10L 15/22 704/275

OTHER PUBLICATIONS www.raytheon.com/news/feature/making-louder-bullet.html, "Raytheon: Making the Bullet Louder: New "3-D Audio" Gives Pilots a Multisensory Heads-up," May 20, 2015, 5 pages.
Oppenheim et al., "From Frequency to Quefrency: A History of the Cepstrum," IEEE Signal Processing Magazine, Sep. 2004, pp. 95-106.

* cited by examiner

*Primary Examiner* — Charlotte M Baker
(74) *Attorney, Agent, or Firm* — Lewis Roca Rothgerber Christie LLP

(57) ABSTRACT

A system for providing voice audio to an operator. The system includes: one or more audio inputs for receiving at least two received voice audio signals; a processing unit, a digital to analog converter, and a loudspeaker. The processing unit is connected to the one or more audio inputs, and configured to: adjust the pitch of a first voice audio signal of the at least two received voice audio signals to form a first adjusted voice audio signal; and combine the first adjusted voice audio signal with at least one other received voice audio signal or adjusted voice audio signal to form a composite audio signal. The pitch in the audio allows the listener to disambiguate one or more speakers or conveys to the listener attributes such as urgency or location information.

16 Claims, 7 Drawing Sheets

VOICE PITCH MODIFICATION TO INCREASE COMMAND AND CONTROL OPERATOR SITUATIONAL AWARENESS

BACKGROUND

1. Field

One or more aspects of embodiments according to the present invention relate to voice communications, and more particularly to voice communications with an operator in a command and control environment.

2. Description of Related Art

In military operations deployed troops or other individuals may be in voice contact with a central operator. It may on occasion be beneficial for an operator to be in contact with several individuals simultaneously, for example to allow the operator to maintain situational awareness. In such a case, it may be challenging for an operator to distinguish the voices of the several individuals.

Similarly, in commercial applications, such as aircraft traffic control, an operator, such as an aircraft traffic controller, may be in voice communication with multiple individuals (e.g., pilots) simultaneously.

In both military and commercial applications, it may be helpful for an operator to have the ability to easily identify higher priority communications. For example, a military coordinator may prioritize a squadron that is engaging an enemy over one that is engaged in less pressing work. Thus, there is a need for an improved system for providing voice communications to an operator in communication with multiple individuals.

SUMMARY

According to an embodiment of the present invention there is provided a system for selectively altering voice audio provided to an operator for identification of specific voices, the system including: one or more audio inputs for receiving at least two received voice audio signals; a processing unit connected to the one or more audio inputs, the processing unit being configured to: adjust the pitch of a first voice audio signal of the at least two received voice audio signals to form a first adjusted voice audio signal; and combine the first adjusted voice audio signal with at least one other received voice audio signal or adjusted voice audio signal to form a composite audio signal; a digital to analog converter configured to receive the composite audio signal from the processing unit and to convert it to analog form, to form an analog composite audio signal; and a first transducer configured to receive the analog composite audio signal and to convert the analog composite audio signal to an acoustic signal for the operator.

In one embodiment, the adjusting of the pitch of the first voice audio signal includes: estimating a pitch frequency of the first voice audio signal; generating filter parameters corresponding to characteristics of the first voice audio signal; adjusting the pitch frequency to form an adjusted pitch frequency; generating a square wave at the adjusted pitch frequency; and filtering the square wave with a filter having the filter parameters.

In one embodiment, the filter is an infinite impulse response filter and the filter parameters are coefficients of the infinite impulse response filter.

In one embodiment, the estimating of the pitch frequency of the first voice audio signal includes calculating a cepstrum of the voice audio signal.

In one embodiment, the adjusting of the pitch frequency includes multiplying the pitch frequency by a factor having an absolute value greater than 1.1 and less than 1.2.

In one embodiment, the system includes a second transducer, wherein the system is configured to drive the first transducer and the second transducer with a stereo signal, corresponding to the first adjusted voice audio signal, with a stereo spatial position at least 30 degrees away from center.

In one embodiment, the system is system is configured to drive the first transducer and the second transducer with a stereo signal, corresponding to the first adjusted voice audio signal, with a stereo spatial position at least 30 degrees away from center, by driving one transducer, of the first transducer and the second transducer, with a first signal, and driving the other transducer, of the first transducer and the second transducer, with a second signal, the first signal having an amplitude greater than that of the second signal.

In one embodiment, the adjusting of the pitch of the first voice audio signal includes: taking a Fourier transform of the first voice audio signal to form a frequency-domain representation of the first voice audio signal; adjusting the frequency-domain representation of the first voice audio signal to form an adjusted frequency-domain representation of the first voice audio signal; and taking an inverse Fourier transform of the adjusted frequency-domain representation of the first voice audio signal.

In one embodiment, the system includes a second transducer, wherein the system is configured to drive the first transducer and the second transducer with a stereo signal, corresponding to the first adjusted voice audio signal, with a stereo spatial position at least 30 degrees away from center.

In one embodiment, the system is system is configured to drive the first transducer and the second transducer with a stereo signal, corresponding to the first adjusted voice audio signal, with a stereo spatial position at least 30 degrees away from center, by driving one transducer, of the first transducer and the second transducer with a first signal, and driving the other transducer, of the first transducer and the second transducer, with a second signal, the first signal having an amplitude greater than the amplitude of the second signal.

According to an embodiment of the present invention there is provided a method for selectively altering voice audio provided to an operator for identification of specific voices, the method including: receiving, at one or more audio inputs, at least two received voice audio signals; adjusting the pitch of a first voice audio signal of the at least two received voice audio signals to form a first adjusted voice audio signal; combining the adjusted voice audio signal with at least one other received voice audio signal or adjusted voice audio signal to form a composite audio signal; and transmitting the output signal to an digital to analog converter.

In one embodiment, the adjusting of the pitch of a voice audio signal includes: estimating a pitch frequency of the first voice audio signal; generating filter parameters corresponding to characteristics of the first voice audio signal; adjusting the pitch frequency to form an adjusted pitch frequency; generating a square wave at the adjusted pitch frequency; and filtering the square wave with a filter having the filter parameters.

In one embodiment, the filter is an infinite impulse response filter and the filter parameters are coefficients of the infinite impulse response filter.

In one embodiment, the estimating of the pitch frequency of the first voice audio signal includes calculating a cepstrum of the first voice audio signal.

In one embodiment, the adjusting of the pitch frequency includes multiplying the pitch frequency by a factor having an absolute value greater than 1.1 and less than 1.2.

In one embodiment, the method includes transmitting an output of the analog to digital converter to a transducer.

BRIEF DESCRIPTION OF THE DRAWINGS

Features, aspects, and embodiments are described in conjunction with the attached drawings, in which.

DETAILED DESCRIPTION

The detailed description set forth below in connection with the appended drawings is intended as a description of exemplary embodiments of a system for voice pitch modification to increase command and control operator situational awareness provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
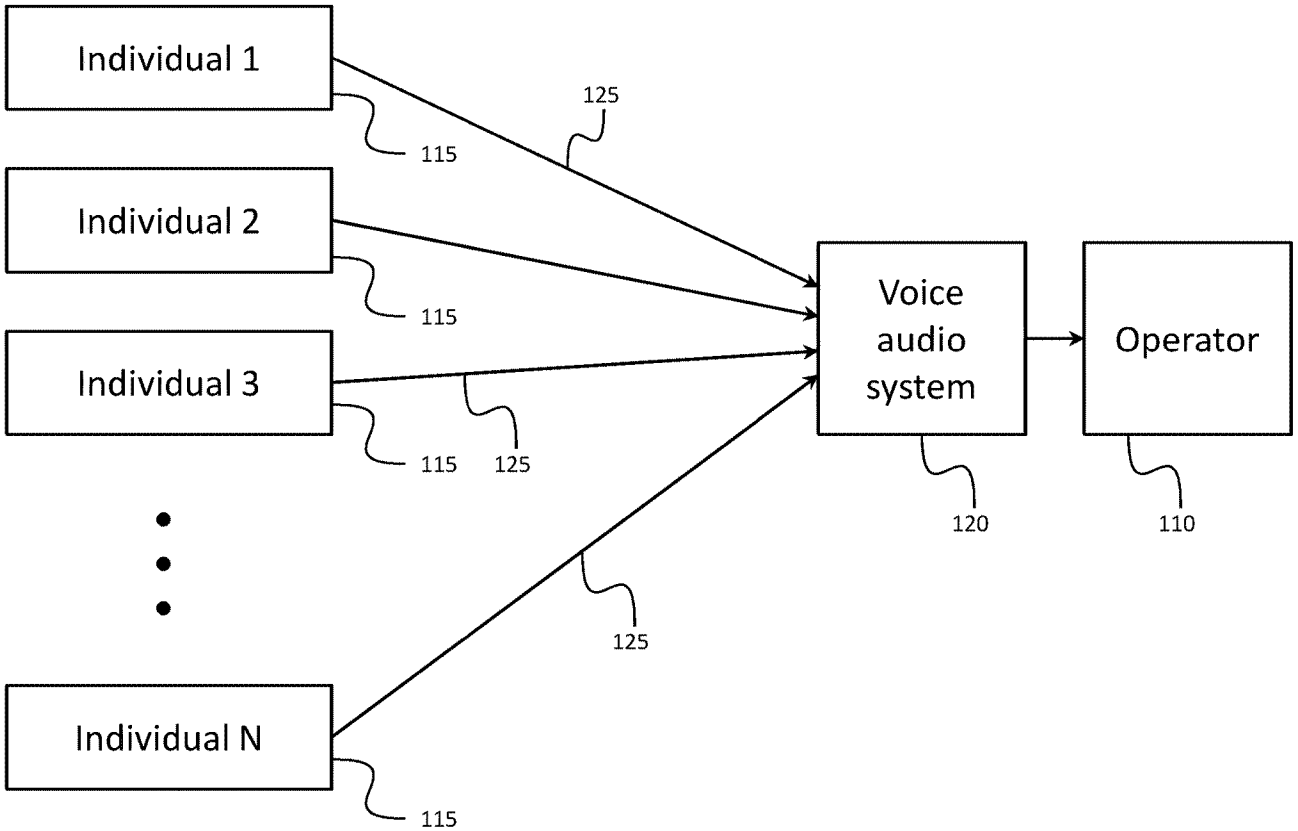
FIG. 1 is a block diagram illustrating a plurality of individuals providing spoken audio communications to an operator, according to an embodiment of the present invention.

Referring to FIG. 1, in one embodiment, an operator 110 is in communication with a plurality of individuals 115. Each individual 115 may be associated with, or part of, an entity, such as a squadron of troops or an aircraft. The operator 110 receives voice communications from each individual 115, through a voice audio system 120. The voice audio system 120 receives a voice audio signal from each of the individuals 115 over a respective voice channel 125, combines them into a single composite audio signal (which may be a stereo signal) and feeds the composite audio signal to the operator 110, e.g., by playing the composite audio signal to the operator 110 through one or more transducers such as loudspeakers, which may be in a pair of headphones.

Each entity may have various characteristics such as a geographic location, a status, and an identifier such as an identifying number or alphanumeric code (e.g., a squadron number). It may be advantageous for the operator 110 to associate with each entity a priority. For example, an operator 110 monitoring a number of squadrons engaged in different activities may want to prioritize communications from an individual 115 who is a leader of a squadron that is about to raid a building over communications from an individual 115 who is a leader of a squadron that is engaged in re-supply operations. In a commercial application, an aircraft traffic controller may want to prioritize communications from aircraft that are within 5 miles of the airport, or aircraft flown by pilots who have announced an intent to use a particularly busy runway.

Figure 2:
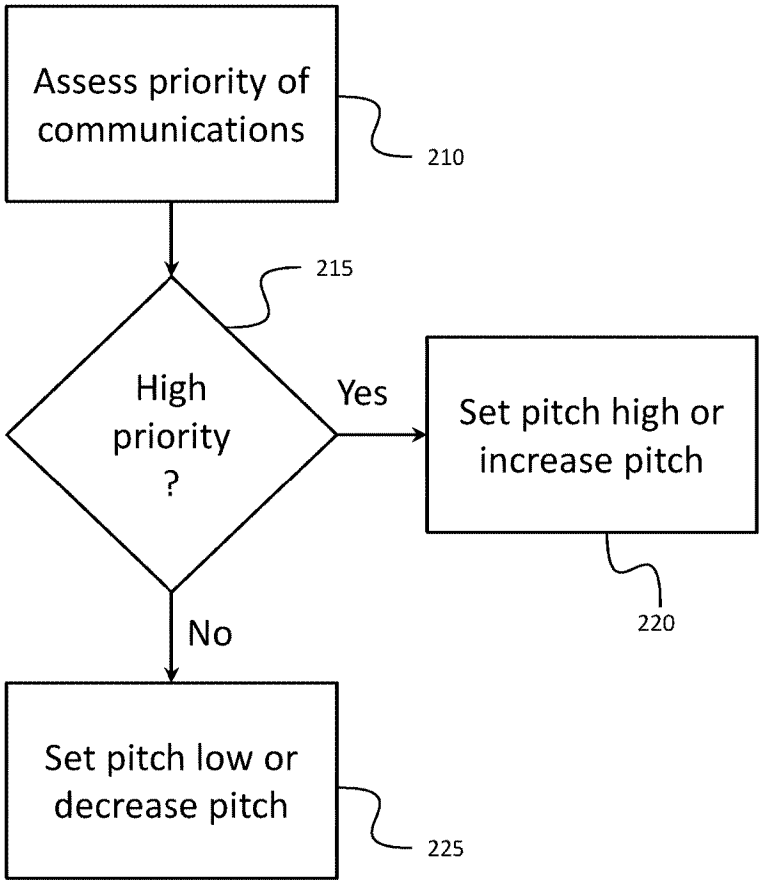
FIG. 2 is a flow chart illustrating a method of changing the pitch of a voice audio signal according to priority, according to an embodiment of the present invention.

Embodiments of the present invention allow an operator 110 to distinguish different voices that otherwise may sound similar, and they also allow an operator 110 to associate the pitch of a voice with the urgency or priority of the communication. Referring to FIG. 2, in one embodiment an operator 110 assesses, in a step 210, the priority of communications the operator 110 is receiving or expects to receive from an individual 115, and sets a pitch adjustment accordingly. For example, if the individual is the leader of a squadron about to go into action, the operator 110 may, in a step 215, determine that the priority of communications from the individual is high, and the operator 110 may, in a step 220, accordingly set the pitch for communications from the individual relatively high, or increase the pitch for communications from the individual. If the individual is the leader of a squadron travelling in an area deemed safe, the operator 110 may, in a step 215, determine that the priority of communications from the individual is low, and, in a step 225, accordingly set the pitch for communications from the individual relatively low, or increase the pitch for communications from the individual. Pitch control may be done one voice channel 125 at a time, so that the pitch adjustment in one voice channel 125 may differ from that in another voice channel 125. In other embodiments the pitch or other qualities of a voice may be adjusted according to factors other than the urgency or priority of the communication. For example, voices from individuals to the left may be adjusted to be higher, and voices from individuals to the right may be adjusted to be lower. In another embodiment, voices from individuals nearer to an airport may be adjusted to be higher, and voices from individuals farther from the airport may be adjusted to be lower. In some embodiments, any attribute of an individual (location, priority, etc.) may be encoded in the pitch of the individual's voice. In some embodiments, a human factors study may be performed to inform the configuration of the system, e.g., to assess whether higher or lower pitches better convey urgency to a listener.

Figure 3B:
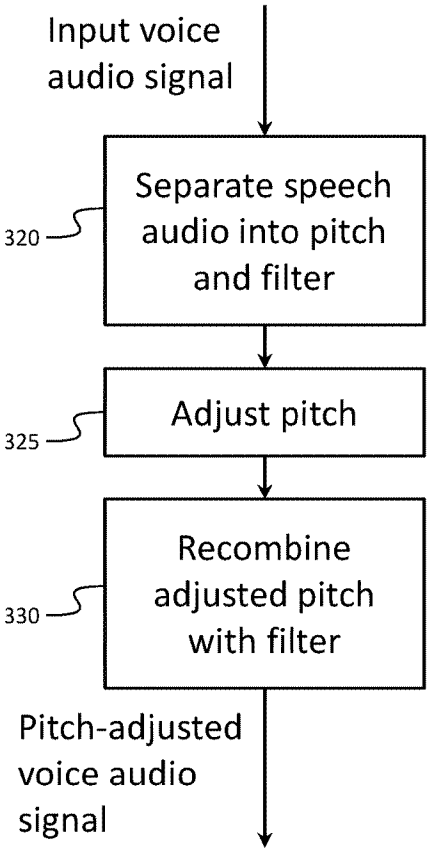
FIG. 3B is a flow chart illustrating a method of adjusting the pitch of a voice audio signal, according to an embodiment of the present invention.
Figure 3A:
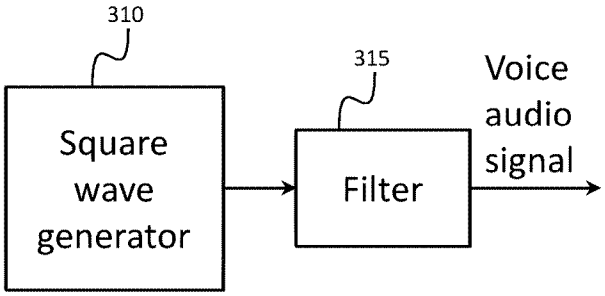
FIG. 3A is a block diagram illustrating a model for a voice audio signal, according to an embodiment of the present invention.

Pitch control may be accomplished by various methods. Referring to FIG. 3A, in one embodiment, a voice audio signal is modeled as the output of a square wave generator 310 (corresponding to the speaker's vocal cords), filtered by a filter 315 (corresponding to the acoustic response of the speaker's mouth). Referring to FIG. 3B, in a method that may be referred to as linear predictive coding, pitch is adjusted in several steps to form a pitch-adjusted voice audio signal from an input voice audio signal. In a first step 320, the voice audio signal is separated into a pitch characteristic and a filter characteristic.

The pitch may be estimated using, for example, cepstrum analysis of the voice audio. The voice audio signal may be (in the time domain) the convolution of (i) the vocal tract impulse response and (ii) a quasi-periodic train of glottal pulses; the Fourier transform of this convolution is the product of the corresponding Fourier transforms, and the logarithm of the Fourier transform is the sum of the logarithms of the corresponding Fourier transforms. The Fourier transform of a comb function being a comb function, the Fourier transform of the quasi-periodic train of glottal pulses may be approximately equal to a comb in frequency. The inverse Fourier transform of the logarithm of the Fourier transform of the voice audio signal is then equal (because of linearity of the inverse Fourier transform) to the sum of (i) the inverse Fourier transform of the logarithm of the Fourier transform of the vocal tract impulse response and (ii) the inverse Fourier transform of the logarithm of the Fourier transform of the quasi-periodic train of glottal pulses. The latter term may have a first, dominant peak corresponding to the pitch period (i.e., the reciprocal of the pitch frequency). Accordingly, the cepstrum of the voice audio signal, defined as the inverse Fourier transform of the logarithm of the Fourier transform of the voice audio signal, and the cepstrum of the voice signal may contain a first, principal peak at the reciprocal of the pitch frequency.

Once the pitch has been determined, a filter may be constructed that, when fed as input a square wave at the pitch frequency, generates as output a signal approximating the voice audio signal. This may be accomplished, for example, by fitting the coefficients of an infinite impulse response filter to a frequency response magnitude calculated by dividing the power spectrum of the voice audio signal by the power spectrum of a square wave at the pitch frequency, and taking the square root of the ratio. The combination of the pitch-estimating step and the filter estimating step corresponds to separating the voice audio signal into a pitch characteristic and a filter characteristic.

In a step 325, the pitch is then adjusted, by generating a square wave at a different frequency from the pitch of the input audio signal. The pitch may be increased by a fraction or decreased by a fraction, or increased or decreased by a certain frequency change. For example, if the pitch in the input voice audio signal is 150 Hz, the pitch may be increased by 10% to 165 Hz or decreased by 10% to 135 Hz, or increased by 30 Hz to 180 Hz or decreased by 30 Hz to 120 Hz. In one embodiment the pitch is set to a specified value that is independent of the pitch in the input voice audio signal. For example, an operator 110 may indicate that the pitch of the voice audio signal from an individual 115 associated with high-priority communications be set to 200 Hz, and that the pitch of the voice audio signal from an individual 115 associated with low-priority communications be set to 100 Hz, regardless of whether the pitch of the respective input voice audio signals is relatively high or relatively low.

In one embodiment 5 voice channels 125 are processed and the pitch is adjusted by fractional changes of +30%, +15%, zero, −15%, and 30%. Adjustments of this magnitude may suffice to allow the operator 110 to quickly distinguish five individuals 115 from one another.

In a step 330, the pitch is then recombined with the filter, by processing, i.e., filtering, the square wave generated in step 325 with the filter formed in step 320. In one embodiment, this is accomplished by processing a sequence of samples of the square wave with an infinite impulse response filter having the coefficients determined in step 320.

Figure 4:
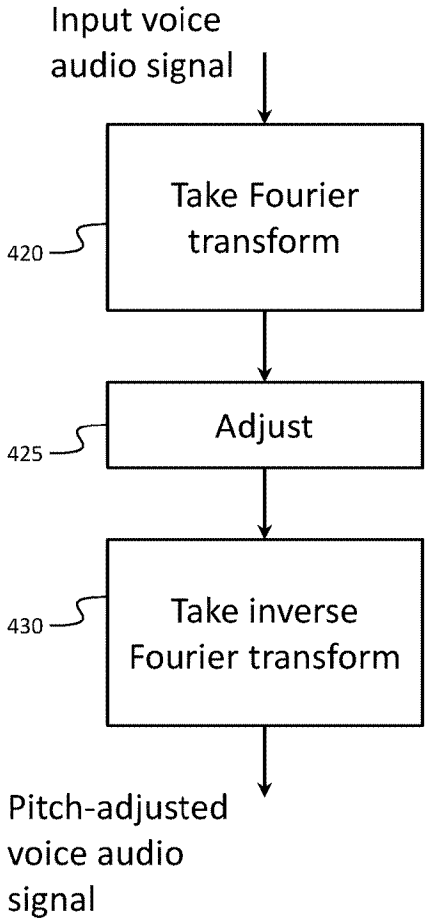
FIG. 4 is a flow chart illustrating a method of adjusting the pitch of a voice audio signal, according to another embodiment of the present invention.

Referring to FIG. 4, in another embodiment that may be referred to as frequency resampling, the pitch of an input voice audio signal is adjusted by taking, in a step 420, a Fourier transform of the input voice audio signal to form a frequency-domain representation of the input voice audio signal, adjusting, in a step 425, the frequency-domain representation of the input voice audio signal, and taking, in a step 430, an inverse Fourier transform of the adjusted frequency-domain representation of the input voice audio signal to form a pitch-adjusted voice audio signal. The frequency-domain representation of the input voice audio signal may be adjusted by shifting each frequency component up or down in frequency by a fraction, e.g., by 10% of its frequency.

Figure 5A:
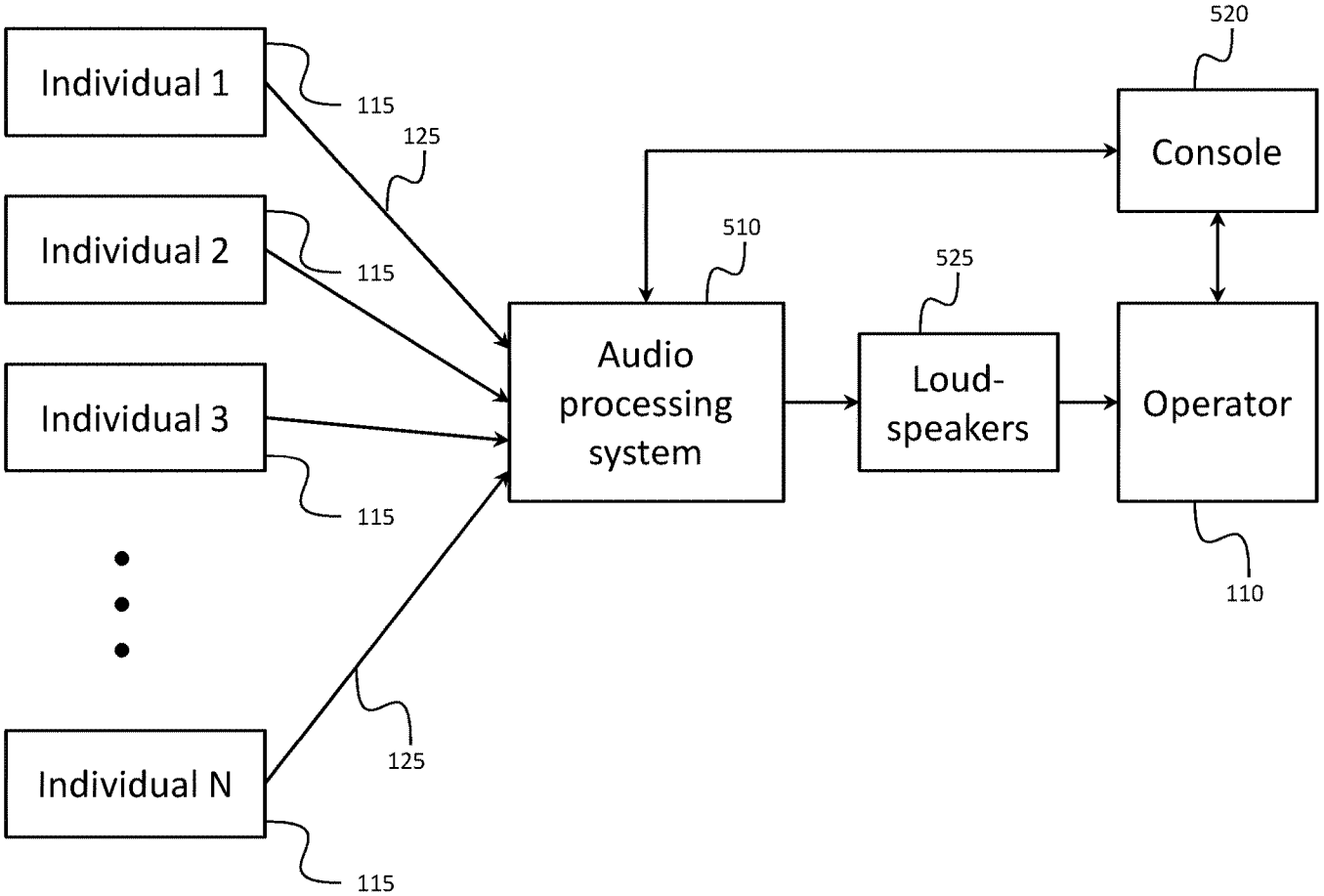
FIG. 5A is a block diagram illustrating a plurality of individuals and an operator interacting through and with a system for providing voice audio to an operator, according to an embodiment of the present invention.

Referring to FIG. 5A, in one embodiment a system for providing voice audio to an operator 110 includes an audio processing system 510, and an operator console 520. Each of several (e.g., N) individuals 115 may be in voice contact with (i.e., providing a voice audio signal to) the audio processing system, each through a respective voice channel 125. For example, each individual 115 may speak into a radio, which may transmit the voice audio signal to an input of the audio processing system.

The signal may be transmitted through the voice channels 125 in digital or analog form; if it is transmitted in analog form, it may be converted to digital form in the audio processing system. The audio processing system 510 may adjust the pitch of the voice audio signal in each voice channel 125 according to instructions or setting provided by the operator 110 to form corresponding pitch-adjusted voice audio signals that it may then combine into a single composite audio signal. The composite audio signal may be an analog signal, e.g., a signal formed from a digital signal by an analog to digital converter. The system may play the composite audio signal the operator 110 (i.e., convert the electrical composite audio signal into an acoustic signal) using one or more transducers, e.g., loudspeakers 525.

The audio processing system 510 may collect, and display to the operator 110, through the console 520, characteristics of the entity with which each individual 115 is associated. For example, for a system in which an operator 110 is managing the operations of a plurality of squadrons, each squadron may have a location, an assigned squadron identification number, and an assigned radio frequency. The inputs to the audio system may be radio signals at different frequencies, one for each squadron, or the inputs may be baseband analog signals or digital signals, each associated with a squadron so that the audio processing system may map a requested pitch change (e.g., for a squadron identified by its location, frequency, or squadron identification number) to a corresponding audio input or channel.

The console may be a computer with a display and user input devices (such as a keyboard and a mouse) and may display information (e.g., in a graphical user interface) allowing the operator 110 to identify each entity, and it may allow the operator 110 to indicate whether the pitch of any individual 115 is to be increased or decreased. For example, the graphical user interface displayed for an operator 110 managing a number of squadrons may show an aerial view of the terrain in which the squadrons are operating, and superimposed on this view may be a plurality of symbols corresponding to the squadrons, each displayed with an identifier, e.g., with a squadron number.

To set or adjust the pitch of a voice audio signal received from an individual 115 associated with one of the squadrons, the operator 110 may for example right-click on one of the squadron symbols and select, from a drop-down menu, an instruction to increase the pitch or to decrease the pitch of the voice audio signal received from the individual 115 associated with the squadron (e.g., the squadron leader). In another embodiment, the operator 110 may select a squadron by clicking on it, and the console may respond by highlighting the selected squadron on the display, and displaying a graphical control element, such as a slider, that the operator 110 may use to adjust the pitch. As mentioned above, in some embodiments the pitch is determined by an attribute of the communicator, such as distance from aircraft. In one embodiment each communicator electronically shares her or his GPS location when transmitting, and this is automatically used to set the pitch, higher for near, and lower for far away.

The blocks of FIG. 5A represent functional elements, and there need not be a one-to-one correspondence between hardware elements and functions. For example, the functions of the console and of the audio processing system may all be performed by a single piece of hardware, e.g., a computer with suitable inputs and outputs and processing capabilities. The audio inputs carrying voice audio signals from the various individuals 115 may be analog inputs, or digital inputs. If the audio inputs are analog inputs, they may carry baseband audio, or, for example, modulated radio frequency carriers. In some embodiments the voice audio signals from the individuals 115 are combined, prior to pitch adjustment, into a single data stream, e.g., by code division multiplexing on a single radio frequency carrier, or they may be transmitted separately to the audio processing system (e.g., over separate radio frequency channels), and converted to digital form in the audio processing system.

Figure 5B:
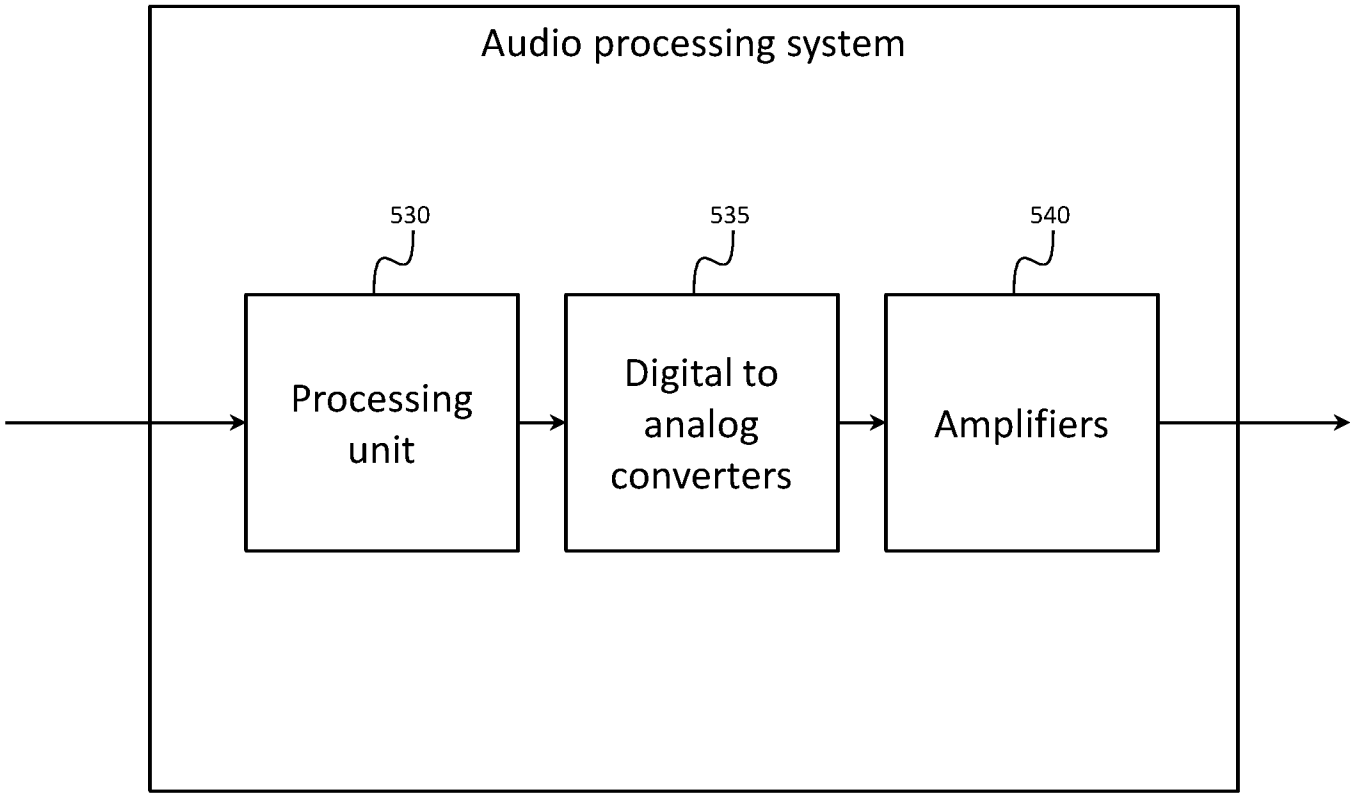
FIG. 5B is a block diagram of an audio processing system, according to an embodiment of the present invention.

Referring to FIG. 5B, in one embodiment the audio processing system includes a processing unit that receives multiple voice audio signal streams in digital format, and generates one or more adjusted voice audio signal streams. The term "processing unit" is used herein to include any combination of hardware, firmware, and software, employed to process data or digital signals. Processing unit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing unit, as used herein, each function is performed either by hardware configured, i.e., hard-wired, to perform that function, or by more general purpose hardware, such as a CPU, configured to execute instructions stored in a non-transitory storage medium. A processing unit may be fabricated on a single printed wiring board (PWB) or distributed over several interconnected PWBs.

In one embodiment the processing unit generates two adjusted voice audio signal streams, corresponding to left and right channels of a stereo audio signal. The adjusted voice audio signal streams may be sent to two digital to analog converters 535, the outputs of which may be sent to two amplifiers 540 that provide amplified analog electrical signals suitable for driving loudspeakers, e.g., two loudspeakers in a pair of headphones. The audio processing system may include other elements not illustrated in FIG. 5B, such as an interface for receiving position information for the entities with which the individuals 115 are associated, and an interface to the console 520.

Figure 6:
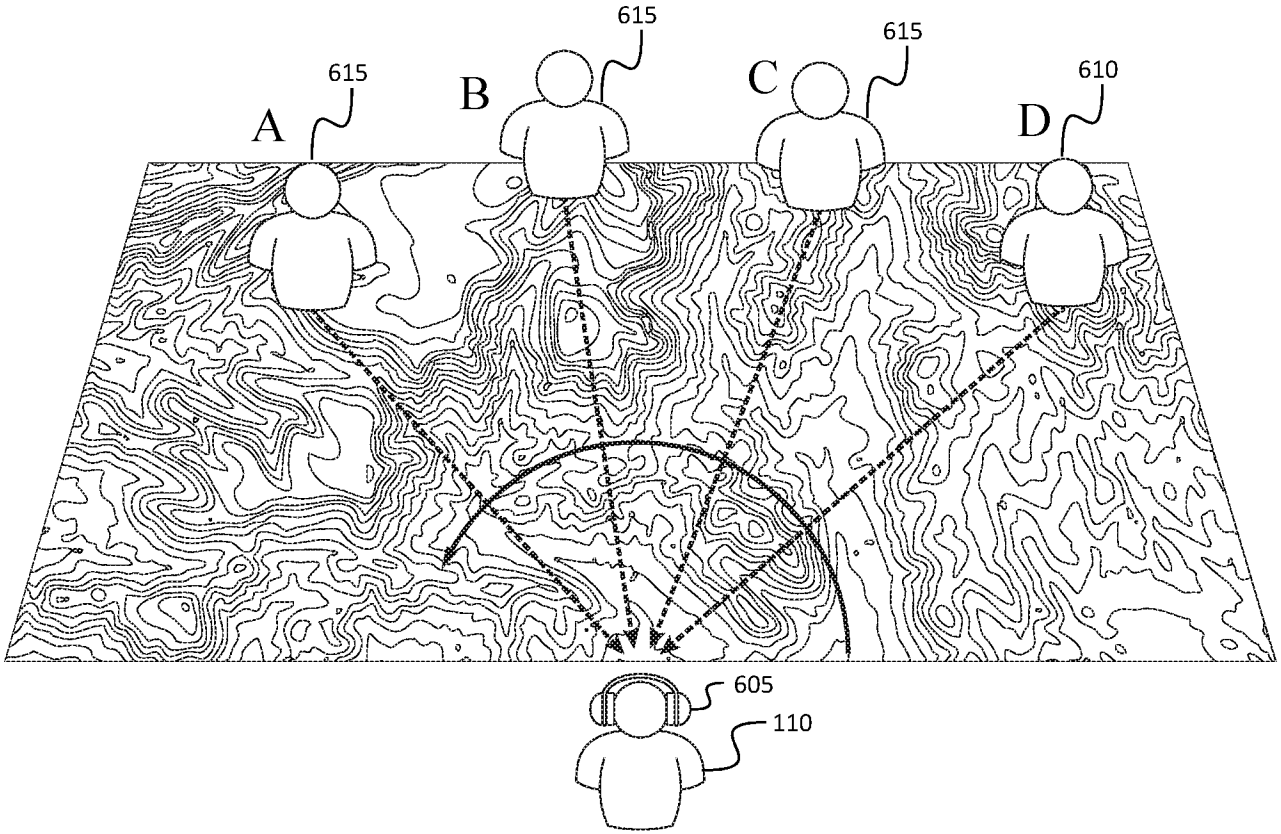
FIG. 6 is a schematic diagram illustrating an operator interacting with headphones and a display, according to an embodiment of the present invention.

Referring to FIG. 6, in one embodiment, the audio processing system provides, in addition to pitch adjustment, stereo spatial position information in the composite audio signal provided to the operator 110. The operator 110 may for example receive the composite audio signal from loudspeakers in a pair of headphones 605, and the audio processing system may cause the perceived direction of the voice audio signal from each of the individuals 115 to be different. This may be accomplished, for example, by adjusting the relative volume in the left and right loudspeakers of each respective voice audio signal.

In some embodiments, relative volume and frequency response differences act as clues to a listener regarding the apparent direction of a received sound (a sound from the left may have a different frequency response curve to the left ear than a sound from the right does to that ear). Accordingly, in one embodiment, the relative frequency response of the signals driving the respective left and right loudspeakers is adjusted to provide stereo imaging.

If the signals supplied to two loudspeakers in a pair of headphones are the same, the corresponding sound may be centered, i.e., it may appear to come from directly in front of, or directly behind, the operator 110. By adjusting the relative volume or relative phase, the system may cause the voice audio heard by the operator 110 to appear to come from directions that are away from center, e.g., 30 degrees or more away from center to the left or to the right of center.

In one embodiment, the console displays a topographic map 610 and four symbols 615 each representing a squadron, each symbol being positioned at a point on the topographic map corresponding to the physical location of the squadron. Simultaneously, any audio transmissions are provided to the operator 110, using stereo imaging, at a stereo spatial direction corresponding to the location of the squadron as displayed on the topographic map. For example, voice audio signal received from an individual 115 in the squadron at the position labelled A in FIG. 6 may sound, to the operator 110, as though it is coming from the left, and voice audio signal received from an individual 115 in the squadron at the position labelled D in FIG. 6 may sound, to the operator 110, as though it is coming from the right. If the operator 110 has identified communications from the squadron at A as having high priority, voice audio signals from the squadron at A may be shifted up in pitch, or shifted to a relatively high pitch, before being combined into the composite audio signal, and if the operator 110 has identified communications from the squadron at D as having low priority, voice audio signals from the squadron at D may be shifted down in pitch, or shifted to a relatively low pitch, before being combined into the composite audio signal. Thus the operator 110 may perceive a voice audio signal with a relatively high pitch coming from the left and a voice audio signal with a relatively low pitch coming from the right.

Although limited embodiments of a system for voice pitch modification to increase command and control operator situational awareness have been specifically described and illustrated herein, many modifications and variations will be apparent to those skilled in the art. Accordingly, it is to be understood that a system for voice pitch modification to increase command and control operator situational awareness employed according to principles of this invention may be embodied other than as specifically described herein. The invention is also defined in the following claims, and equivalents thereof.

What is claimed is:

1. A system for selectively altering voice audio provided to an operator for identification of specific voices, the system comprising:

one or more audio inputs for receiving at least two received voice audio signals;

a processing unit connected to the one or more audio inputs, the processing unit being configured to:

adjust the pitch of a first voice audio signal of the at least two received voice audio signals to form a first adjusted voice audio signal; and combine the first adjusted voice audio signal with at least one other received voice audio signal or adjusted voice audio signal to form a composite audio signal;

a digital to analog converter configured to receive the composite audio signal from the processing unit and to convert it to analog form, to form an analog composite audio signal; and a first transducer configured to receive the analog composite audio signal and to convert the analog composite audio signal to an acoustic signal for the operator.

2. The system of claim 1, wherein the adjusting of the pitch of the first voice audio signal comprises:

estimating a pitch frequency of the first voice audio signal;

generating filter parameters corresponding to characteristics of the first voice audio signal;

adjusting the pitch frequency to form an adjusted pitch frequency;

generating a square wave at the adjusted pitch frequency; and filtering the square wave with a filter having the filter parameters.

3. The system of claim 2, wherein the filter is an infinite impulse response filter and the filter parameters are coefficients of the infinite impulse response filter.

4. The system of claim 2, wherein the estimating of the pitch frequency of the first voice audio signal comprises calculating a cepstrum of the voice audio signal.

5. The system of claim 2, wherein the adjusting of the pitch frequency comprises multiplying the pitch frequency by a factor having an absolute value greater than 1.1 and less than 1.2.

6. The system of claim 1, further comprising a second transducer, wherein the system is configured to drive the first transducer and the second transducer with a stereo signal, corresponding to the first adjusted voice audio signal, with a stereo spatial position at least 30 degrees away from center.

7. The system of claim 6, wherein the system is system is configured to drive the first transducer and the second transducer with a stereo signal, corresponding to the first adjusted voice audio signal, with a stereo spatial position at least 30 degrees away from center, by driving one transducer, of the first transducer and the second transducer, with a first signal, and driving the other transducer, of the first transducer and the second transducer, with a second signal, the first signal having an amplitude greater than that of the second signal.

8. The system of claim 1, wherein the adjusting of the pitch of the first voice audio signal comprises:

taking a Fourier transform of the first voice audio signal to form a frequency-domain representation of the first voice audio signal;

adjusting the frequency-domain representation of the first voice audio signal to form an adjusted frequency-domain representation of the first voice audio signal; and taking an inverse Fourier transform of the adjusted frequency-domain representation of the first voice audio signal.

9. The system of claim 8, further comprising a second transducer, wherein the system is configured to drive the first transducer and the second transducer with a stereo signal, corresponding to the first adjusted voice audio signal, with a stereo spatial position at least 30 degrees away from center.

10. The system of claim 9, wherein the system is system is configured to drive the first transducer and the second transducer with a stereo signal, corresponding to the first adjusted voice audio signal, with a stereo spatial position at least 30 degrees away from center, by driving one transducer, of the first transducer and the second transducer with a first signal, and driving the other transducer, of the first transducer and the second transducer, with a second signal, the first signal having an amplitude greater than the amplitude of the second signal.

11. A method for selectively altering voice audio provided to an operator for identification of specific voices, the method comprising:

receiving, at one or more audio inputs, at least two received voice audio signals;

adjusting the pitch of a first voice audio signal of the at least two received voice audio signals to form a first adjusted voice audio signal;

combining the adjusted voice audio signal with at least one other received voice audio signal or adjusted voice audio signal to form a composite audio signal; and transmitting the output signal to an digital to analog converter.

12. The method of claim 11, wherein the adjusting of the pitch of a voice audio signal comprises:

estimating a pitch frequency of the first voice audio signal;

generating filter parameters corresponding to characteristics of the first voice audio signal;

adjusting the pitch frequency to form an adjusted pitch frequency;

generating a square wave at the adjusted pitch frequency; and filtering the square wave with a filter having the filter parameters.

13. The method of claim 12, wherein the filter is an infinite impulse response filter and the filter parameters are coefficients of the infinite impulse response filter.

14. The method of claim 12, wherein the estimating of the pitch frequency of the first voice audio signal comprises calculating a cepstrum of the first voice audio signal.

15. The method of claim 12, wherein the adjusting of the pitch frequency comprises multiplying the pitch frequency by a factor having an absolute value greater than 1.1 and less than 1.2.

16. The method of claim 11, further comprising transmitting an output of the analog to digital converter to a transducer.

* * * * *